US005167767A

United States Patent [19]

Owiti et al.

[11] Patent Number: 5,167,767

[45] Date of Patent: Dec. 1, 1992

[54] PAPER MILL PRESS FELT CONDITIONER

[75] Inventors: Clarice A. Owiti; Abdul Q. Khan, both of Jacksonville, Fla.

[73] Assignee: Betz PaperChem, Inc., Jacksonville, Fla.

[21] Appl. No.: 674,486

[22] Filed: Mar. 25, 1991

[51] Int. Cl.[5] ..... D21F 1/32

[52] U.S. Cl. ..... 162/199; 162/DIG. 4

[58] Field of Search ..... 162/199, DIG. 4; 252/351, DIG. 1

[56] References Cited

U.S. PATENT DOCUMENTS

| | | | |
|---|---|---|---|
| 3,398,047 | 8/1968 | Michalski | 162/48 |
| 3,873,417 | 3/1975 | Otrhalek et al. | 162/168 |
| 3,992,249 | 11/1976 | Farley | 162/72 |
| 4,184,912 | 1/1980 | Panton | 162/199 |
| 4,810,301 | 3/1989 | Yoshioka et al. | 162/158 |
| 4,895,622 | 1/1990 | Barnett | 162/199 |

FOREIGN PATENT DOCUMENTS

| | | | |
|---|---|---|---|
| 0176285 | 10/1982 | Japan | 162/158 |

OTHER PUBLICATIONS

Chem. Abstract, No. 83-731360/32.

*Primary Examiner*—Kenneth M. Schor
*Assistant Examiner*—Brenda Lamb
*Attorney, Agent, or Firm*—Alexander D. Ricci; Steven D. Boyd

[57] ABSTRACT

This invention relates to an improved press felt conditioning treatment which controls the deposition of polymerically flocculated particulate substances in a press felt. The treatment comprises applying to the felt an effective inhibiting amount of a conditioner comprising a combination of a polymethylnaphthalene sulfonate and a type A phosphate ester comprising a nonyl phenol hydrophobe based phosphate ester having between 6 and 10 moles of ethylene oxide and a mono to diester ratio of approximately 60 to 40 or a type B phosphate ester comprising a tridecyl alcohol hydrophobe based phosphate ester having between 6 and 10 moles of ethylene oxide and a mono to diester ratio of about 60 to 40. The use of this combination was found to be especially effective at preventing the deposition of polymerically flocculated particulate substances in a press felt and paper machine.

13 Claims, No Drawings

PAPER MILL PRESS FELT CONDITIONER

FIELD OF THE INVENTION

The present invention relates to the inhibition of the deposition of particulate materials in a papermaking system. More particularly, the present invention relates to a press felt conditioner which controls the deposition of particulate materials in the press felts of nonacidic papermaking systems.

BACKGROUND OF THE INVENTION

In a paper manufacturing process which employs coated broke as a portion of the total pulp furnish, ironically charged relatively high molecular weight water soluble polymers are often employed to enhance retention of cellulosic fibers, fines, and inorganic fillers. The addition of these polymers produces a cleaner process stream by reducing the solids level in the process filtrate circuit. The high molecular weight polymers control solids by absorbing onto solid particulate surfaces in the papermaking furnish slurry and invoking charge neutralization (coagulation) and/or bridging (flucculation) mechanisms which cause the solid particles to flocculate. The flocculate can be retained by the formed mat of cellulosic fibers more easily than smaller individual particles. However, one disadvantage of the use of these polymers is that the flocculated particulate material can be transferred from the surface of the sheet to the paper machine press felts. I the flocculated state, the particles cannot pass through the fine, porous structure of the press felt and they become entrapped therein. If not controlled by adequate felt conditioning practices, these agglomerated particulate substances can severely impair the ability of the press felts to absorb water thereby requiring reduced production rates and shortening the useful life of the felts. In addition, it has been found that common polymeric retention aids can render normally effective prior art felt conditioners useless or marginally effective in part because of the size of the flocculated particles.

The use of polymeric retention aids is particularly critical for the efficient operation of neutral and alkaline paper making processes (pH approximately 6.0 to 8.5). Without the use of such polymeric retention aids, common system additives such as cellulose reactive sizes, alkenyl succinic anhydride (ASA) and alkene ketene diner (AKD), can cycle up in the process system and cause numerous operational problems, particularly in the press sections. Most of the particulates which are transferred from the sheet to the press felts in a flocculated state are too large to easily pass through the press felt. The contaminants thus become imbedded in the felt structure or are transferred back to the sheet and cause spots, holes or deposits in the dryer section.

Press felts associated with coated alkaline fine paper can experience excessive filling due to pitch deposits which arise from paper making furnish components such as sizing agents, alumina and fiber fines. Paper coating binders such as polyvinyl acetate or styrene butadiene lattices and inorganic coating pigments such as clay, calcium carbonate and titanium dioxide can also contribute to felt filling.

Analysis of used press felts from neutral and alkaline papermaking systems reveal a number of polymerically flocculated materials. Significant quantities of inorganic fillers such as; calcium carbonate, clay, and titanium dioxide alone or in association with particles of latex coating binders such as, polyvinyl acetate or styrene butadiene rubber are often found. Other types of contaminants that can be associated with the agglomerates, in significantly lower quantities can include starches, natural wood pitch (fatty esters, fatty acids and salts, resin acids and salts) cellulosic fiber fines, microbiological contaminants and absorbants, such as talc or bentonite, oil based defoamers and insoluble metal hydroxides. All of these contaminants can be present to some degree based on a variety of factors such as the pulp furnish and water sources, grade of material produced, type and quantity of system additives, pulp production methods and equipment design and capacities.

Processes to inhibit contaminating deposition in paper making felts are known in the art. U.S. Pat. No. 4,895,622 Barnett et al. discloses a process for press felt conditioning which controls the deposition of polymerically flocculated particulate substances by treating the press felts with a conditioner comprising a relatively low molecular weight organic, anionic polymer and at least one hydrophilic, nonionic or anionic surfactant. U.S. Pat. No. 3,398,047, Michalski, discloses a method of controlling pitch deposition in pulp and papermill systems by treating the system with a blend of a ligand and an organic sulfonate. U.S. Pat. No. 4,184,912, Payton discloses a method of preventing pitch formation by dispersing and emulsifying pitch particles in the pulp furnish to an exceptionally fine state and uniformly distributing the particles throughout the finished paper. The pitch deposition is controlled by the addition of a three component formulation comprising a nonionic surfactant plus an anionic surfactant and a low molecular weight anionic polymer. The three component mixture is added to the papermaking pulp system at a point prior to where pitch deposits normally form. In U.S. Pat. No. 3,992,249, Farley, a process for inhibiting pitch deposition is disclosed wherein the pulp is washed with an aqueous solution of anionic polymers having between 25 to 85 mole percent hydrophobic-oleophilic linkages and 15 to 70 mole percent hydrophilic acid linkages to complex with the pitch. The pitch-polymer complex is washed away with water.

U.S. Pat. No. 3,873,417, Otrhalek et al. discloses a pitch and pigment dispersant which comprises a neutralized solution of polymer prepared by free radical polymerization of an alpha, beta unsaturated acid with an alkyl ester and an allyl alcohol.

SUMMARY OF THE INVENTION

The present invention relates to a papermaking press felt conditioning treatment which controls the deposition of retention aid flocculated particulate substances in a press felt. More particularly, the present invention relates to the use of one or more of a group of phosphate esters in combination with polymethylnaphthalene sulfonates to control the deposition of polymerically flocculated particulates in press felts under non-acidic conditions.

The press felt conditioners of the present invention are preferably applied by metering into one or more fresh water showers directed onto a press felt between the press nip and the vacuum or uhle box utilized for dewatering the felt. The combination of a polymethylnaphthalene sulfonate and one or more of a group of phosphate esters was found to produce a synergistic felt conditioning effect which is unexpected based upon the conditioning effects of the individual components.

Unexpected and surprising press felt conditioning results, with respect to retention aid flocculated particulates, have been discovered when a polymethylnaphthalene sulfonate and a nonyl phenol hydrophobe based (type A) or tridecyl alcohol hydrophobe based (type B) phosphate ester having 6 to 10 moles of ethylene oxide and a mono to diester ratio of about 60 to 40 are employed. The polymethylnaphthalene sulfonate preferably has a molecular weight between about 500 and 11,000. The type A phosphate esters are nonyl phenol hydrophobe based having between 6 and 10 moles of ethylene oxide and a mono to diester ratio of approximately 60 to 40. The type B phosphate esters are tridecyl alcohol hydrophobe based having between 6 and 10 moles of ethylene oxide and a mono to diester ratio of about 60 to 40.

The use of these phosphate esters in combination with a polymethylnaphthalene sulfonate was found to provide an unexpectedly effective felt conditioning treatment for controlling the deposition of polymerically flocculated particulate substances in a papermaking press felt. Type C phosphate esters (phenol hydrophobe based having between 6 and 10 moles of ethylene oxide and a mono to diester ratio of about 90 to 10) or propylene oxide/ethylene oxide block copolymers having a molecular weight between about 4000 and 35,000 were found to not provide the results of the combination of the present invention.

DESCRIPTION OF THE PREFERRED EMBODIMENTS

The present invention relates to a process for inhibiting the deposition of polymerically flocculated particulates in a felt in the press section of a papermaking system wherein the felt is prone to such deposition. The press felt conditioner of the present invention is typically applied to press felts in an aqueous shower. The press felt conditioner of the present invention comprises a polymethylnaphthalene sulfonate and a type A or type B phosphate ester having between 6 and 10 moles of ethylene oxide and a mono to diester ratio of approximately 60 to 40.

The ratio of polymethylnaphthalene sulfonate to phosphate ester may range from about 4 to 1 to about 1 to 4. It has been found that an unexpected effectiveness in controlling the deposition of polymerically flocculated particulates is provided by the specific combinations of the present invention.

The polymethylnaphthalene sulfonates of the present invention preferably have a molecular weight of from about 500 to about 11,000. The polymethylnaphthalene sulfonates have the general formula:

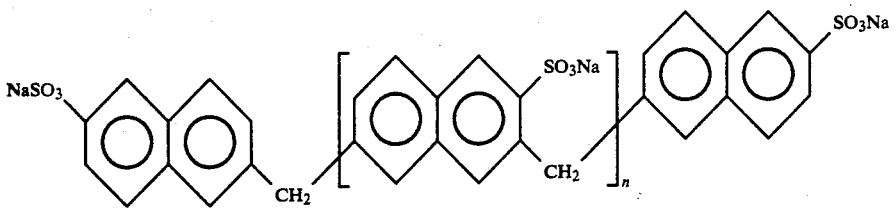

wherein n is from about 2 to 42.

The phosphate esters of the present invention are hydrophilic anionic surfactants based upon either nonyl phenol hydrophobe (type A) or tridecyl alcohol hydrophobe (type B). The type A phosphate esters based upon nonyl phenol hydrophobe have between 6 and 10 moles of ethylene oxide and a mono to diester ratio of approximately 60 to 40.

The type A phosphate esters have the general formula:

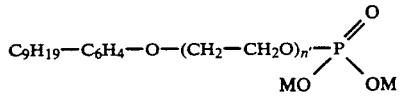

wherein n' is the number of moles of ethylene oxide and ranges from about 6 to 10 and M is hydrogen or sodium.

The type B phosphate esters based upon tridecyl alcohol hydrophobe have between 6 and 10 moles of ethylene oxide and a mono to diester ratio of approximately 60 to 40. The type B phosphate esters have the general formula:

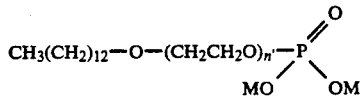

wherein n' is the number of moles of ethylene oxide and ranges from 6 to 10 and M is hydrogen or sodium.

It was discovered that a combination of one or more of the above polymethylnaphthalene sulfonates with one or more of the above phosphate ester based anionic surfactants in a ratio of from about 4 to 1 to bout 1 to 4 provides effective continuous press felt conditioning in papermaking systems where the press felts are subjected to contamination by polymerically flocculated contaminants encountered in coated and uncoated alkaline and neutral paper process systems. It is also believed that the present invention may also be effectively used to prevent the same type of contaminants from building up on paper machine press section press rolls when fed through an aqueous shower directed upon the press rolls. In either case, the required amount or concentration of phosphate ester polymethylnaphthalene sulfonate mixture needed will depend upon, among other things, the volume of shower water employed, the paper production rate and the concentration of polymerically flocculated contaminants. Generally, the total concentration of polymethylnaphthalene sulfonate/-phosphate ester mixture added to the aqueous shower medium is from about 10 to about 1500 parts per million parts of aqueous medium. Preferably, the mixture is added at concentrations ranging from about 100 to about 300 parts per million parts of aqueous shower medium.

In order to more clearly illustrate the present invention, the following data was developed. The following examples are included as illustrations of the present invention and should not be construed as limiting the scope thereof.

EXAMPLES

The examples contained herein demonstrate the unexpected efficacy of the combination of the present invention. The data was obtained utilizing a continuous press felt conditioning test apparatus and a simulated coated alkaline fine paper contaminant system. The testing incorporated a clean (unused) press felt sample of known initial weight and air permeability placed upon a heavy mesh support screen through which the treated or untreated contaminant solution was pressed. A simulated coated alkaline papermaking white water contaminant test slurry was employed in these examples. The simulated control alkaline contaminant slurry consisted of the following:

| Ingredient | Concentration (ppm) |
|---|---|
| Ground Calcium Carbonate | 375.00 |
| Clay | 125.00 |
| Fatty ester/fatty acid pitch mixture | 50.00 |
| *Coating solids (cured, redispersed 15% slurry) | 300.00 |

-continued

| Ingredient | Concentration (ppm) |
|---|---|
| Alkaline Size (ASA/starch, 1:3 ratio, 10% slurry) | 48.75 |
| Cationic Retention Aid | 2.00 |

Table 1 contains data generated with the above test system and sets out the performance characteristics of a number of commercially available surfactants and polymers. As can be seen from Table 1, the individual components were tested and the percent weight gain and percent permeability decrease of the felt measured. Thereafter, a series of dual component treatments were tested. As shown, when a polymethylnaphthalene sulfonate was employed in combination with a type A or type B phosphate ester there was an unexpected improvement in felt conditioning over what would be expected from the results of the individual components. When a type C phosphate ester or other prior art nonionic surfactants were employed in combination with a polymethylnaphthalene sulfonate, the unexpected improvement was not found.

TABLE 1

PERFORMANCE OF VARIOUS SURFACTANTS AND POLYMETHYLNAPHTHALENE SULFONATE ALONE AND IN COMBINATION IN A FELT CONDITIONING TEST SYSTEM UTILIZING A SIMULATED POLYMERICALLY (RETENTION AID) FLOCCULATED COATED ALKALINE FINE PAPER FELT CONTAMINANT SYSTEM.

| Conditioning Agent | Treatment Concentration (ppm) | % Wt. Gain Of Test Felt (over clean control) | % Permeability Loss (over clean control) |
|---|---|---|---|
| Untreated Control | — | 21.69 | 62.84 |
| Single Component Treatments | | | |
| Phosphate Ester (A) | 150 | 16.05 | 49.89 |
| | 450 | 12.65 | 70.51 |
| | 600 | 11.84 | 44.13 |
| Phosphate Ester (B) | 150 | 21.82 | 66.01 |
| | 450 | 15.69 | 61.16 |
| | 600 | 13.41 | 56.53 |
| Phosphate Ester (C) | 150 | 22.13 | 71.22 |
| | 600 | 12.08 | 55.09 |
| Octyl Phenol Hydrophobe based Phosphate Ester | 150 | 21.79 | 63.32 |
| | 600 | 23.24 | 70.09 |
| Polymethylnaphthalene Sulfonate | 150 | 19.19 | 61.84 |
| | 450 | 13.34 | 57.67 |
| | 600 | 10.88 | 50.00 |
| Sodium Lignosulfonate | 600 | 23.77 | 79.59 |
| Propylene oxide/ethylene oxide Block Copolymer | 150 | 15.36 | 63.13 |
| | 450 | 13.82 | 52.75 |
| | 600 | 13.77 | 48.43 |
| Ethoxylated nonyl phenol* | | | |
| Type 1 | 150 | 18.88 | 56.91 |
| | 600 | 21.05 | 60.45 |
| Type 2 | 300 | 21.07 | 59.50 |
| | 600 | 22.44 | 79.66 |
| Polyacrylic Acid** | | | |
| Type 1 | 150 | 19.48 | 67.43 |
| | 450 | 21.82 | 76.13 |
| Type 2 | 150 | 21.71 | 70.1 |
| | 450 | 18.26 | 65.1 |
| Dual-Component Treatments: Polymethylnaphthalene Sulfonate Plus | Phosphate Ester (A) | | |
| Ratios of 1:1 | 150 | 14.02 | 57.00 |
| | 450 | 10.56 | 36.63 |
| | 600 | 9.45 | 40.74 |
| Ratios of 2:1 | 150 | 11.13 | 49.49 |
| | 450 | 9.69 | 41.06 |
| | 600 | 9.66 | 40.37 |
| Ratios of 3:1 | 150 | 11.28 | 57.38 |
| | 450 | 12.81 | 35.25 |
| | 600 | 12.41 | 27.87 |
| Ratios of 1:3 | 150 | 13.27 | 57.38 |
| | 450 | 14.01 | 39.36 |
| | 600 | 14.61 | 40.65 |

TABLE 1-continued

PERFORMANCE OF VARIOUS SURFACTANTS AND POLYMETHYLNAPHTHALENE SULFONATE ALONE AND IN COMBINATION IN A FELT CONDITIONING TEST SYSTEM UTILIZING A SIMULATED POLYMERICALLY (RETENTION AID) FLOCCULATED COATED ALKALINE FINE PAPER FELT CONTAMINANT SYSTEM.

| Conditioning Agent | Treatment Concentration (ppm) | % Wt. Gain Of Test Felt (over clean control) | % Permeability Loss (over clean control) |
|---|---|---|---|
| | Phosphate Ester (B) | | |
| Ratios of 1:2 | 150 | 15.74 | 70.85 |
| | 450 | 12.05 | 62.42 |
| | Phosphate (C) | | |
| Ratios 1:1 | 150 | 23.33 | 70.16 |
| | 600 | 14.08 | 49.96 |
| | Propylene Oxide/Ethylene Oxide Block Copolymer | | |
| Ratios 1:1 | 150 | 14.88 | 53.66 |
| | 450 | 13.49 | 50.95 |
| | 600 | 12.89 | 43.36 |
| Ratios 1:3 | 150 | 14.30 | 47.06 |
| | 450 | 12.26 | 44.15 |
| | 600 | 21.77 | 43.54 |
| Ratios 3:1 | 150 | 14.94 | 50.67 |
| | 450 | 12.74 | 42.55 |
| | 600 | 13.40 | 51.19 |

*Ethoxylated nonyl phenol surfactant; Type 1: 9.5 moles ethylene oxide, HLB value 12.9, molecular weight 632, Type 2: 12 moles ethylene oxide, HLB value 14.2, average molecular weight 748.

**Polyacrylic acid; Type 1: polyacrylic acid molecular weight about 5,000, Type 2: copolymer of acrylic acid and hydroxypropane sulfonate, molecular weight about 4,000.

Table 2 summarizes the data generated to evaluate the effectiveness of the present invention in a system in which an alkene ketene diner (AKD) size was employed in place of an alkenyl succinic anhydride (ASA) size. All other test conditions were the same as shown above.

TABLE 2

COMPARISON OF PERFORMANCE OF POLYMETHYLNAPHTHALENE SULFONATE/PHOSPHATE ESTER TYPE A IN COATED ALKALINE CONTAMINANT TEST SYSTEM WITH ALTERNATE SIZING MATERIALS

| Treatment Concentration (ppm) | | ASA SIZE % WT Gain | ASA SIZE % Permeability Loss | AKD SIZE % Wt Gain | AKD SIZE % Permeability Loss |
|---|---|---|---|---|---|
| Control | | 21.61 | 71.13 | 20.31 | 81.79 |
| Ratio of 2:1 | 75 | 15.35 | 54.30 | 18.42 | 68.9 |
| | 150 | 11.13 | 49.49 | 9.76 | 49.87 |
| | 600 | 9.66 | 40.37 | 7.87 | 41.14 |

Table 3 summarizes data generated in a test system as described above in which a simulated uncoated alkaline paper white water contaminant test slurry was employed which consisted of the following:

| Ingredient | Concentration (ppm) |
|---|---|
| Ground Calcium Carbonate | 525.00 |
| Titanium Dioxide | 75.00 |
| Clay | 150.00 |
| Alkaline size (ASA/starch 1:3 ratio 10% slurry) | 75.00 |
| Cationic Retention Aid | 1.00 |

TABLE 3

PERFORMANCE OF POLYMETHYLNAPHTHALENE SULFONATE/PHOSPHATE ESTER TYPE A BLEND VS PRIOR ART FELT CONDITIONER IN UNCOATED ALKALINE CONTAMINANT TEST SYSTEM

| Conditioning Agent | Treatment Concentration (ppm) | % Wt. Gain | % Permeability Loss |
|---|---|---|---|
| Control | | 12.19 | 52.5 |
| Polymethylnaphthalene Sulfonate/Phosphate Ester | | | |
| Ratio of 2:1 | 54 | 6.15 | 30.2 |
| | 150 | 3.24 | 14.8 |
| Polyacrylic Acid/ | 60 | 8.56 | 34.2 |
| Ethoxylated Nonylphenol Blend | 150 | 7.16 | 24.0 |
| Polyacrylic Acid/ | 75/150 | 7.8 | 25.10 |
| Octyl phenol ethoxylate (1:3) | | | |
| Polyacrylic Acid | 75/150 | 9.80 | 38.64 |
| diethyl phenol ethoxylate (1:2) | | | |
| Polyacrylic Acid/ | 75/150 | 8.29 | 36.40 |

TABLE 3-continued

PERFORMANCE OF POLYMETHYLNAPHTHALENE SULFONATE/PHOSPHATE ESTER TYPE A BLEND VS PRIOR ART FELT CONDITIONER IN UNCOATED ALKALINE CONTAMINANT TEST SYSTEM

| Conditioning Agent | Treatment Concentration (ppm) | % Wt. Gain | % Permeability Loss |
|---|---|---|---|
| ethoxylated polyoxypropylene glycol (1:2) | | | |
| Polyacrylic Acid/ alkyl polyglycocide (1:2) | 75/150 | 10.50 | 38.20 |

As can be seen from Tables 1 through 3, the combination of the present invention provides positive felt conditioning regardless of whether the felt contaminant is that of a coated or uncoated alkaline paper furnish.

While this invention has been described with respect to particular embodiments thereof, it is apparent that numerous other forms and modifications of the invention will be obvious to those skilled in the art. The appended claims in this invention should be construed to cover all such obvious forms and modifications which are within the true spirit and scope of the present invention.

What is claimed is:

1. A process for inhibiting polymeric retention aid flocculated particulate deposition in a paper system which comprises applying to surfaces in said system an effective inhibiting amount of a conditioner consisting of:

a. a polymethylnaphthalene sulfonate in combination with b. a phosphate ester selected from the group consisting of nonyl phenol hydrophobe based and tridecyl alcohol hydrophobe based phosphate esters each having from about 6 to 10 moles of ethylene oxide and a mono to diester ratio of about 60 to 40.

2. The process of claim 1 wherein the ratio of said sulfonate to said phosphate ester is from about 4 to 1 to about 1 to 4.

3. The process of claim 1 wherein said paper system is a neutral or alkaline system.

4. The process of claim 1 wherein the pH of said system is from about 6 to about 8.5.

5. The process of claim 1 wherein said conditioner is applied to a paper press felt in a shower of an aqueous medium including said conditioner.

6. The process of claim 5 wherein said conditioner is added in an amount from about 10 to about 1500 ppm parts of aqueous media.

7. The process of claim 1 wherein said paper system is a coated or uncoated paper system.

8. A method of inhibiting deposition of polymeric retention aid flocculated particulates in a press section of a paper machine wherein the press felt is prone to such deposition and the felt is conditioned by showering with an aqueous media, which comprises adding to said aqueous media an effective amount for the purpose of a felt conditioner consisting essentially of:

a. a polymethylnaphthalene sulfonate of the general formula

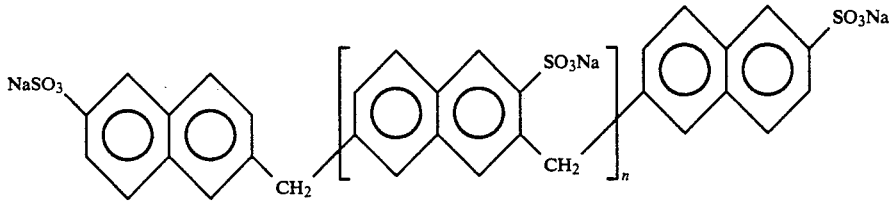

wherein n ranges from about 2 to 42 in combination with b. a phosphate ester selected from the group consisting of nonyl phenol phosphate esters of the general formula

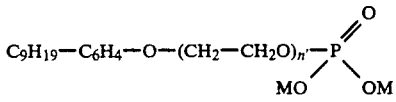

and tridecyl alcohol phosphate esters of the general formula

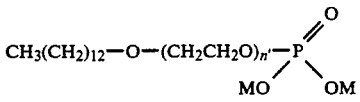

wherein n' ranges from about 6 to 10 and M is hydrogen or sodium.

9. The method of claim 8 wherein the ratio of said sulfonate to phosphate ester ranges from about 4 to 1 to about 1 to 4.

10. The method of claim 8 wherein said paper system is a neutral or alkaline papermaking system.

11. The method of claim 8 wherein the pH of said system is from about 6 to about 8.5.

12. The method of claim 8 wherein said felt conditioner is added in an amount from about 10 to about 1500 ppm parts of said aqueous medium.

13. The method of claim 8 wherein said paper machine is in a coated or uncoated paper system.

* * * * *